US008490516B2

(12) United States Patent
Baba et al.

(10) Patent No.: US 8,490,516 B2
(45) Date of Patent: Jul. 23, 2013

(54) SCREW DRIVING MACHINE HAVING COMBUSTION-TYPE POWER MECHANISM AND ELECTRIC POWER MECHANISM

(75) Inventors: Norikazu Baba, Hitachinaka (JP); Yasuki Ohmori, Hitachinaka (JP); Shouichi Hirai, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 357 days.

(21) Appl. No.: 12/875,989

(22) Filed: Sep. 3, 2010

(65) Prior Publication Data

US 2011/0073336 A1 Mar. 31, 2011

(30) Foreign Application Priority Data

Sep. 30, 2009 (JP) ..... 2009-228341
Sep. 30, 2009 (JP) ..... 2009-228342

(51) Int. Cl.
*B25B 21/00* (2006.01)

(52) U.S. Cl.
USPC ..... 81/54; 173/104; 81/463

(58) Field of Classification Search
USPC ..... 81/463, 464, 54, 57.13; 173/47, 173/48, 104, 109, 217; 227/8, 9, 10
See application file for complete search history.

(56) References Cited

U.S. PATENT DOCUMENTS

| | | | | |
|---|---|---|---|---|
| 3,385,378 | A * | 5/1968 | Weber et al. | 173/47 |
| 4,609,053 | A * | 9/1986 | Ragnmark | 173/104 |
| 5,161,624 | A * | 11/1992 | Beck et al. | 173/47 |
| 5,996,874 | A * | 12/1999 | Fukushima et al. | 227/8 |
| 6,886,730 | B2 * | 5/2005 | Fujisawa et al. | 227/8 |
| 7,013,985 | B2 | 3/2006 | Sasaki et al. | |
| 7,121,442 | B2 | 10/2006 | Akiba et al. | |
| 7,500,587 | B2 | 3/2009 | Akiba et al. | |
| 2008/0156842 | A1 * | 7/2008 | Panasik | 227/8 |

FOREIGN PATENT DOCUMENTS

| | | | |
|---|---|---|---|
| JP | 2005-103728 | A | 4/2005 |
| JP | 2005-329533 | A | 12/2005 |

* cited by examiner

*Primary Examiner* — Hadi Shakeri
(74) *Attorney, Agent, or Firm* — Kilpatrick Townsend & Stockton LLP

(57) ABSTRACT

A screw driving machine includes a bit that is movable to strike a screw against a workpiece and rotatable to rotate the screw to the workpiece, a combustion-type power mechanism including a spark plug that ignites combustible gas filled in a combustion chamber to apply striking force to cause the bit to strike the screw, a motor that generates a rotative force when supplied with electric force, and a power transmission mechanism that transmits the rotative force generated at the motor to the bit to cause the bit to rotate.

6 Claims, 10 Drawing Sheets

SCREW DRIVING MACHINE HAVING COMBUSTION-TYPE POWER MECHANISM AND ELECTRIC POWER MECHANISM

CROSS REFERENCE TO RELATED APPLICATION

This application claims priority from Japanese Patent Applications No. 2009-228341 and No. 2009-228342 both filed Sep. 30, 2009. The entire content of each of these priority applications is incorporated herein by reference.

TECHNICAL FIELD

The present invention relates to a screw driving machine including an combustion-type power mechanism and an electric power mechanism.

BACKGROUND

There has been provided an electric screw fastening machine powered by compressed air. Japanese Patent Application Publication No. 2005-103728 discloses an electric screw fastening machine powered by AC power or battery. Also, Japanese Patent Application Publication No. 2005-329533 discloses a combustion-type nail driving machine powered by expansion of air caused by gas combustion energy.

SUMMARY

Because the electric screw fastening machine powered by compressed air needs a compressor for generating compressed air and a connection air hose for connecting the compressor to a driving mechanism, the electric screw fastening machine is large in size, and operability thereof is unsatisfactory. Also, because the electric screw fastening machine does not have a mechanism to hammer a screw, it takes longer time to fasten the screw to a workpiece compared to a case where the screw is previously hammered into the workpiece.

In view of the foregoing, it is an object of the invention to provide a small-sized screw driving machine capable of driving a screw at a higher torque for a longer time.

In order to attain the above and other objects, the invention provides a screw driving machine including a housing, a bit, a push lever, a combustion-type power mechanism, a motor, and a power transmission mechanism. The bit is movable from a first position to a second position relative to the housing to strike a screw against a workpiece, and is rotatable about an axis thereof to rotate the screw to the workpiece. The push lever is movable between a third position and a fourth position relative to the housing, and moves from the third position to the fourth position when pressed against the workpiece. The combustion-type power mechanism defines a combustion chamber when the push lever is located at the fourth position. The combustion-type power mechanism includes a spark plug that ignites combustible gas filled in the combustion chamber to apply striking force to the bit toward the second position, causing the bit to strike the screw. The spark plug ignites the combustible gas when supplied with electric force. The motor generates a rotative force when supplied with electric force. The power transmission mechanism transmits the rotative force generated at the motor to the bit, causing the bit to rotate.

According to another aspect, the present invention provides a screw driving machine including a housing, a bit, a combustion-type power mechanism, a motor, and a power transmission mechanism. The bit is movable from a first position to a second position relative to the housing to strike a screw against a workpiece, and is rotatable about an axis thereof to rotate the screw to the workpiece. The combustion-type power mechanism generates and supplies a first driving force to the bit so as to move the bit from the first position toward the second position. The motor generates a second driving force. The power transmission mechanism transmits the second driving force from the motor to the bit so as to rotate the bit. The motor starts generating the second driving force before the combustion-type power mechanism supplies the first driving force to the bit.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
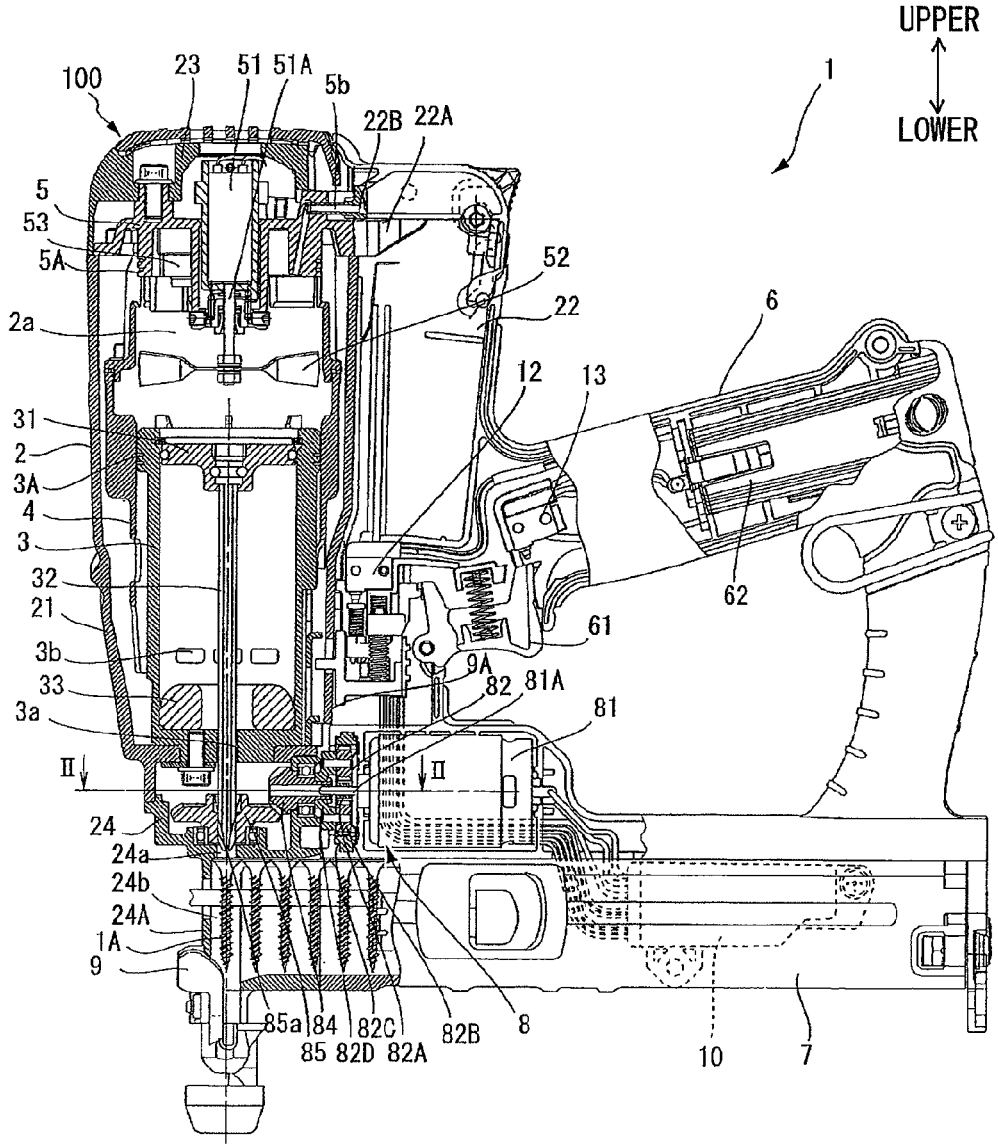
FIG. 1 is a cross-sectional view of a screw driving machine according to a first embodiment of the invention.

Combustion-type screw driving machines according to embodiments of the invention will be described while referring to the accompanying drawings wherein like parts and components are designated by the same reference numerals to avoid duplicating description.

The terms "upward," "downward," "upper," and "lower" will be used throughout the description assuming that the screw driving machines are disposed in an orientation shown in FIG. 1.

A combustion-type screw driving machine 1 according to a first embodiment of the invention will be described with reference to FIGS. 1 to 4.

As shown in FIG. 1, the screw driving machine 1 includes a housing 2, a handle 6, a magazine 7, an electrical power mechanism 8, a push lever 9, and a control device 10.

The housing 2 includes a main housing 21, a canister accommodation section 22, and a head cover 23. The main housing 21 is formed with a discharge port (not shown) at a lower section, and accommodates a cylinder 3, a combustion chamber frame 4, and a cylinder head 5 therein.

Both the cylinder 3 and the combustion chamber frame 4 are in a cylindrical shape extended in a vertical direction (up-to-down direction), and the cylinder 3 is accommodated in the combustion chamber frame 4. The cylinder 3 has an open upper end and a bottom wall formed with a hole 3*a*. A seal member 3A is provided along a peripheral edge of the opening at the top of the cylinder 3.

The cylinder 3 is also formed with a discharge hole 3*b* near the bottom of the cylinder 3. The discharge hole 3*b* is in communication with the discharge port (not shown) formed in the main housing 21. A discharged-air check valve (not shown) is disposed at the discharge hole 3*b* for allowing discharged air to flow from inside to the outside of the cylinder 3. Also, a discharge cover (not shown) is provided to cover the discharge hole 3*b*.

The cylinder 3 accommodates therein a piston 31, a bit 32, and a bumper 33. The piston 31 is substantially in a disk shape and contacts the inner peripheral surface of the cylinder 3 through a plurality of seal members (not shown) so as to vertically partition the internal space of the cylinder 3. The piston 31 is movable along the vertical direction relative to the cylinder 3. An upper end of the bit 32 is attached to the piston 31 such that the bit 32 is rotatable about an axis thereof. The bit 32 extends downward from the piston 31 and has a regular hexagonal cross section. A tip end (lower end) of the bit 32 is in a shape that can be engaged with a screw 1A and is extended to the outside of the cylinder 3 through the hole 3*a*. The bumper 33 is disposed in the cylinder 3 at a position lower than the piston 31 to prevent the piston 31 from directly contacting the bottom wall of the cylinder 3 when the piston 31 moves downward. The bumper 33 also absorbs impact of the piston 31 when the bit 32 strikes the screw 1A in a manner described later.

The combustion chamber frame 4 has an open upper end and an open lower end. The combustion chamber frame 4 is movable relative to the cylinder 3, and is connected to the push lever 9 via a coupling member (not shown). A spring (not shown) is interposed between the cylinder 3 and part of the coupling member to urge both the coupling member and the combustion chamber frame 4 downward. When the combustion chamber frame 4 moves upward against the urging force of the spring, the inner peripheral surface of the combustion chamber frame 4 hermetically abuts the seal member 3A.

The cylinder head 5 is fixed to the main housing 21 at a position higher than the combustion chamber frame 4. The cylinder head 5 has a lower surface formed with a ring-shaped recess (not shown) for receiving the upper part of the combustion chamber frame 4 when the combustion chamber frame 4 is positioned at the highest position. A ring-shaped sealing member 5A is disposed on a surface defining the recess of the cylinder head 5.

With this configuration, when the combustion chamber frame 4 is located at the highest position, the sealing member 5A hermetically abuts the upper part of the combustion chamber frame 4. As a result, the cylinder 3, the piston 31 accommodated in the cylinder 3, the combustion chamber frame 4, and the cylinder head 5 together define a combustion chamber 2*a*.

The cylinder head 5 is formed with a passage 5*b* for leading combustible gas from a gas canister 22A (described later) to the combustion chamber 2*a*. The cylinder head 5 also has a fan motor 51 and a spark plug 53. The fan motor 51 is shock-absorbingly supported to the cylinder head 5, and a rotary shaft 51A of the fan motor 51 extends downward along the vertical direction such that a lower end of the rotary shaft 51A is located within the combustion chamber 2*a*. The fan motor 51 is driven to rotate when electric power is supplied from a battery 62 (described later).

A fan 52 is attached to the rotary shaft 51A of the fan motor 51 so as to rotate together with the rotary shaft 51A. Rotation of the fan 52 within the combustion chamber 2*a* draws fresh air into the combustion chamber 2*a* through an inlet (not shown) formed in the head cover 23, agitates combustible gas in the combustion chamber 2*a* to generate a suitable gas mixture, and discharges an exhaust gas after combustion from the combustion chamber 2*a* suitably.

The spark plug 53 is located in the cylinder head 5 such that its ignition point is located at the surface defining the combustion chamber 2*a*, so the spark plug 53 can ignite the combustible gas in the combustion chamber 2*a*. Because the spark plug 53 boosts supplied voltage and then discharges, it takes a time duration T1 (about 10 msec) between energization and ignition, i.e., from the moment the spark plug 53 is energized to the moment the spark plug 53 is ignited. The ignition of the combustible gas moves the piston 31 and the bit 32 downward.

The canister accommodation section 22 is disposed to the side of the main housing 21 and elongated along the vertical direction. The canister accommodation section 22 accommodates the gas canister 22A therein. The gas canister 22A contains the combustible gas. The gas canister 22A has a nozzle 22B at the top, through which the gas canister 22A can release the combustible gas at a constant amount. A tip end of the nozzle 22B is connected to the passage 5*b*, and the gas canister 22A is connected to a linking member (not shown) whose end is disposed at the top of the combustion chamber frame 4. When the combustion chamber frame 4 moves upward to the highest position, the combustion chamber frame 4 urges the gas canister 22A through the liking member (not shown) toward the main housing 21. As a result, the combustible gas is released from the gas canister 22A to the combustion chamber 2*a* through the passage 5*b*.

The head cover 23 is disposed over the main housing 21 to protect the cylinder head 5 and supports the fan motor 51.

A nose section 24 is disposed below the main housing 21 in the vicinity of the discharge port mentioned above, and is fixed to the main housing 21. The nose section 24 supports the cylinder 3, and is formed with a hole 24*a* in communication with the hole 3*a* formed in the cylinder 3. The nose section 24 has a guide member 24A located lower than the hole 24*a*. The guide member 24A defines a passage 24*b* through which the tip end of the bit 32 reciprocates. The passage 24*b* also functions as an ejection hole when the bit 32 drives the screw 1A.

The handle 6 is extending from the canister accommodation section 22 in a direction intersecting the vertical direction and includes a trigger 61, a second contact switch 13, and the battery 62.

The trigger 61 is disposed at a lower part of a base of the handle 6. The second contact switch 13 is disposed above the trigger 61 for sensing the movement of the trigger 61. When the trigger 61 is pulled upward to contact the second contact switch 13, the second contact switch 13 outputs an ON signal.

When the trigger 61 is out of contact with the second contact switch 13, on the other hand, the second contact switch 13 outputs an OFF signal.

The battery 62 is detachably accommodated in the handle 6 and supplies electric power to the fan motor 51, the spark plug 53, and a motor 81 (described later).

The magazine 7 is connected to the nose section 24, and accommodates therein a plurality of screws 1A. The magazine 7 is provided with an urging member (not shown) for urging the screws 1A toward the nose section 24, so that one of the screws 1A is placed in the passage 24*b* defined in the nose section 24, which is on an excursion of the bit 32.

The electrical power mechanism 8 is disposed between the magazine 7 and the handle 6 at a position near where the magazine 7 is connected to the nose section 24, and is covered with part of the housing 2. The electrical power mechanism 8 includes the motor 81, a planetary gear mechanism 82, a bevel gear 84, and a final gear 85. The planetary gear mechanism 82 and the bevel gear 84 together function as an intermediate gear section, and the intermediate gear section and the final gear 85 together function as a power transmission mechanism.

The motor 81 is a well-known motor having an output shaft 81A. The output shaft 81A is extending in a direction along a radial direction of a circle coaxial with the axis of the bit 32. When the motor 81 is activated (supplied with the electric power), the motor 81 starts rotating and accelerates the rotation speed to a predetermined rotation speed. After reaching the predetermined rotation speed, the motor 81 keeps rotating at the predetermined rotation speed. More specifically, the motor 81 is configured to reach the predetermined rotation speed in a time duration $\Delta T$ after the activation.

The planetary gear mechanism 82 is a deceleration mechanism well-known in the art, and includes a sun gear 82A, a plurality of revolution gears 82B, a ring gear 82C, and a planetary carrier 82D. The sun gear 82A is connected to and rotates coaxially and integrally with the output shaft 81A of the motor 81. The ring gear 82C is fixed to the housing 2, and the revolution gears 82B are disposed between the sun gear 82A and the ring gear 82C. The planetary carrier 82D rotatably supports the revolution gears 82B, and one end of the planetary carrier 82D is connected to the bevel gear 84.

Figure 2:
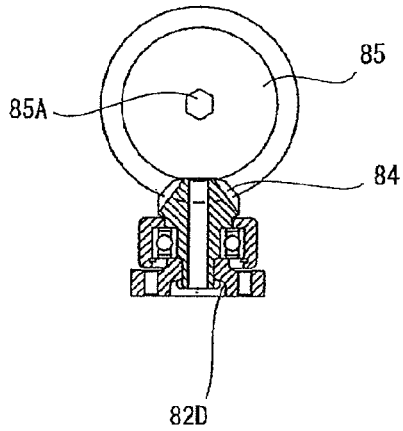
FIG. 2 is a cross-sectional view taken along a line II-II of FIG. 1.

The final gear 85 is a bevel gear rotatably supported to the nose section 24 at a position higher than the passage 24*b* so as to be rotatable integrally and coaxially with the bit 32. The bit 32 is splined to the final gear 85. More specifically, as shown in FIG. 2, the final gear 85 is in meshing engagement with the bevel gear 84 and changes the axis of rotation to the axis direction of the bit 32, which intersects the axis direction of the output shaft 81A. Also, the final gear 85 is formed with a through hole 85A that penetrates through the center of the final gear 85 in the axis direction thereof. The through hole 85A has a hexagonal cross section and receives the bit 32 therein. With this configuration, the final gear 85 is supported on the bit 32. Because the bit 32 also as a hexagonal cross section, the bit 32 is movable in the vertical direction relative to the final gear 85, but is not rotatable relative to the final gear 85.

It should be noted that the cross section of the bit 32 is not limited to be a rod shape with the regular hexagonal cross section, but may have various other configurations that can be splined to the final gear 85.

With reference to FIG. 1, the push lever 9 is disposed so as to be movable in the vertical direction with respect to the nose section 24. The push lever 9 has at the bottom section a contact part that contacts a workpiece during screw-driving operations. The push lever 9 also has an urging member 9A.

A first contact switch 12 is disposed beneath the canister accommodation section 22 for sensing the movement of the push lever 9. When the push lever 9 moves upward, the urging member 9A contacts and urges against the first contact switch 12. As a result, the first contact switch 12 outputs an ON signal. When the push lever 9 is out of contact with the first contact switch 12, on the other hand, the first contact switch 12 outputs an OFF signal.

Figure 3:
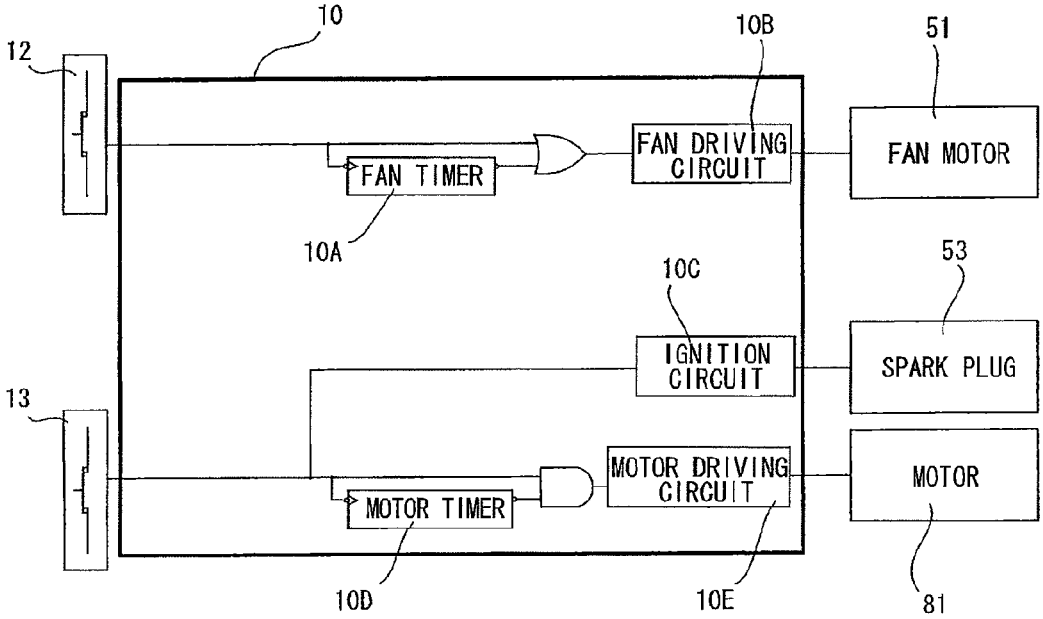
FIG. 3 is a block diagram showing an electric configuration of the screw driving machine of FIG. 1.

The control device 10 is disposed inside the magazine 7 and connected to the battery 62. As shown in FIG. 3, the control device 10 includes a fan timer 10A, a fan driving circuit 10B, an ignition circuit 10C, a motor timer 10D, and a motor driving circuit 10E. The fan driving circuit 10B is connected to the fan motor 51, and the ignition circuit 10C is connected to the spark plug 53. The motor driving circuit 10E is connected to the motor 81.

Figure 4:
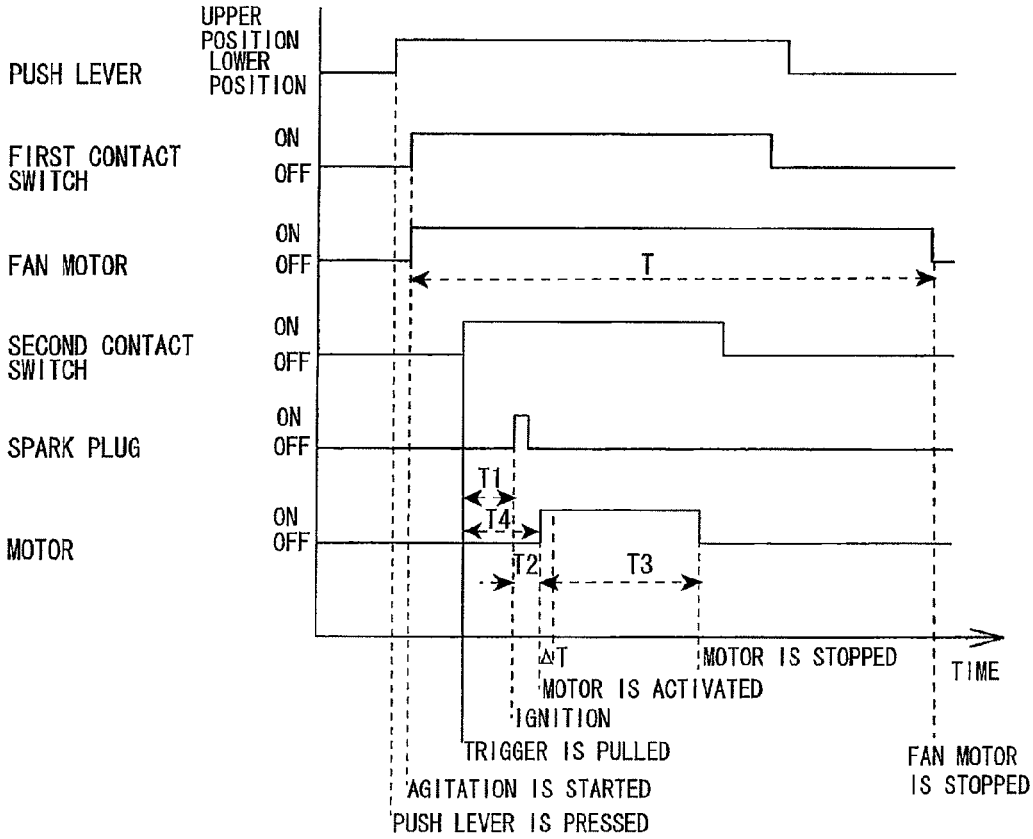
FIG. 4 is a time chart of operations of the screw driving machine of FIG. 1.

With reference to FIGS. 3 and 4, the fan timer 10A is configured to output an ON signal for a time duration T when the first contact switch 12 outputs the ON signal. The fan driving circuit 10B is configured to supply the electric power from the battery 62 to the fan motor 51 when at least one of the first contact switch 12 and the fan timer 10A outputs the ON signal.

The ignition circuit 10C supplies the electric power from the battery 62 to the spark plug 53 for an extremely short time when the second contact switch 13 outputs the ON signal.

The motor timer 10D is configured to start measuring a time duration T4, which is the sum of the time duration T1 and a time duration T2, when the second contact switch 13 outputs the ON signal, and to output an ON signal for a time duration T3 when the time duration T4 has elapsed. The motor timer 10D also outputs an OFF signal after the output of the ON signal. The time duration T1 is the time between the energization and the ignition of the spark plug 53 as described above.

The motor driving circuit 10E is configured to supply the electric power from the battery to the motor 81 when both the second contact switch 13 and the motor timer 10D output the ON signals. That is, the motor driving circuit 10E starts supplying the electric power to the motor 81 when the time duration T2 has elapsed after the ignition of the spark plug 53 or when the time duration T4 has elapsed after the second contact switch 13 outputs the ON signal.

Next, operations of the screw driving machine 1 will be described with reference to the time chart shown in FIG. 4. First, an operator presses the screw driving machine 1 against the workpiece while gripping the handle 6, such that the contact part of the push lever 9 abuts a target section of the workpiece. As a result, the push lever 9 moves upward relative to the housing 2, and thus the combustion chamber frame 4 moves upward to define the combustion chamber 2*a* together with the cylinder head 5. The upward movement of the combustion chamber frame 4 releases the combustible gas in the gas canister 22A as described above, and the released combustible gas is supplied into the combustion chamber 2*a* through the passage 5*b*.

Also, the push lever 9 moved upward contacts the first contact switch 12, causing the first contact switch 12 to output the ON signal. As a result, the fan timer 10A starts outputting the ON signal. Further the fan driving circuit 10B starts supplying the electric power to the fan motor 51, which in turn starts rotating the fan 52. Rotation of the fan motor 51 in the combustion chamber 2*a* agitates the combustible gas and generates the gas mixture of the combustible gas and air. Note that even if the first contact switch 12 outputs the OFF signal thereafter, the fan driving circuit 10B continues to supply the power to the fan motor 51 as long as the fan timer 10A outputs the ON signal. Thus, the fan 52 keeps rotating for the time duration T set by the fan timer 10A.

Next, the operator pulls the trigger 61, causing the second contact switch 13 to output the ON signal. As a result, the ignition circuit 10C energizes the spark plug 53, igniting the combustible gas in the combustion chamber 2*a*. This ignition lowers the piston 31 and the bit 32 toward the lower dead point to strike the screw 1A against the workpiece. As described above, the time duration T1 has elapsed from when the operator pulled the trigger 61 to when the combustible gas is ignited.

On the other hand, the motor timer 10D outputs the ON signal when the time duration T4 has elapsed after the second contact switch 13 outputs the ON signal. As a result, the motor driving circuit 10E supplies the electric power to the motor 81, and the motor 81 rotates to generate driving force.

The driving force of the motor 81 is transmitted to the final gear 85 via the output shaft 81A and the planetary gear mechanism 82 in a reduced speed, and rotates the bit 32. The motor 81 reaches the predetermined rotation speed when the time duration ΔT has elapsed after the energization, and then enters a steady rotation state, i.e., keeps rotating at the predetermined speed, as described above. Because the motor 81 is energized when the time duration T2 has elapsed after the ignition of the spark plug 53 as described above, the motor 81 enters the steady rotation state when a time duration (T2+ΔT) has elapsed after the ignition of the spark plug 53. The time duration T2 is set such that the time duration (T2+ΔT) is substantially equal to a time duration that requires the bit 32 to reach a predetermined position to strike the screw 1A against the workpiece after the ignition of the spark plug 53. With this configuration, the bit 32 strikes the screw 1A against the workpiece while rotating, and the motor 81 enters the steady rotation state at substantially the same time as when the bit 32 strikes the screw 1A. Rotation of the bit 32 after the striking rotates the screw 1A into the workpiece. Because the motor 31 can generate the maximum driving force in the steady rotation state, the bit 32 can securely rotate the screw 1A from the exact moment when the bit 32 strikes the screw 1A.

When the motor timer 10D outputs the OFF signal after outputting the ON signal for the time duration T3, the motor driving circuit 10E stops supplying the electric power to the motor 81, and thus the bit 32 stops rotating, even if the second contact switch 13 still outputs the ON signal. Setting the time duration T3 to an appropriate value can prevent the screw 1A from being rotated (screwed) excessively.

After the rotation (screwing) is completed, the operator releases the trigger 61, causing the second contact switch 13 to output the OFF signal. Then, the operator lifts up the screw driving machine 1 away from the workpiece. As a result, the push lever 9 moves downward with respect to the housing 2, and the first contact switch 12 outputs the OFF signal. Also, the combustion chamber frame 4 moves downward to open the combustion chamber 2*a*. In this condition, the fan 52 is still rotating, so the exhaust gas is discharged to outside the combustion chamber frame 4.

Note that the cylinder 3, the combustion chamber frame 4, the cylinder head 5, the push lever 9, the piston 31, the fan motor 51, the fan 52, and the battery 62 together define a combustion-type power mechanism 100.

With this configuration, the driving power generated by combusting the combustible gas (gas-generated power) is used for striking the screw 1A that requires the largest energy, and the driving power generated at the motor 81 is used for rotating the screw 1A that requires less energy. That is, the striking of the screw 1A and the rotation of the screw 1A are performed using different power sources. Thus, even when the battery 62 is used for driving the motor 81 as in this embodiment, it is possible to reduce the electric power consumption, increasing the longevity of the battery 62. It is also possible to provide a relatively large energy for each of the striking and the rotating (screwing). Thus, it is possible to strike the screw 1A with a greater power and to rotate the same with a greater torque. Further, because different mechanisms (the combustion-type power mechanism 100 and the electrical power mechanism 8) are used for the striking and the rotating, it is possible to simplify the configuration of each mechanism, reducing the power transmission loss.

Further, disposing the electrical power mechanism 8 in a space between the handle 6 and the housing 2 makes an effective use of the space, reducing the size of the screw driving machine 1. Employing the above-descried configuration of the electrical power mechanism 8 makes it possible to configure the electrical power mechanism 8 of existing members.

Because the electrical power mechanism 8 is configured of a combination of a planetary gear and a bevel gear, the electrical power mechanism 8 is made compact. This further reduces the overall size of the screw driving machine 1 and increases the degree of freedom of a location where the electrical power mechanism 8 can be disposed in the screw driving machine 1. Moreover, the planetary gear mechanism 82 realizes a relatively high torque at the final gear 85 even if the motor 81 is small and low power. This also reduces the screw driving machine 1 in size.

Because the battery 62 is commonly used for the fan motor 51, the spark plug 53, and the motor 81, it is possible to reduce the number of components of the screw driving machine 1, reducing the size of the screw driving machine 1.

Next, a screw driving machine according to a first modification of the above-described first embodiment will be described with reference to FIGS. 5 and 6.

In the above-described first embodiment, the energization timing of the motor 81 is delayed than the ignition timing of the spark plug 53. However, the motor 81 is energized before the ignition in this modification.

Figure 5:
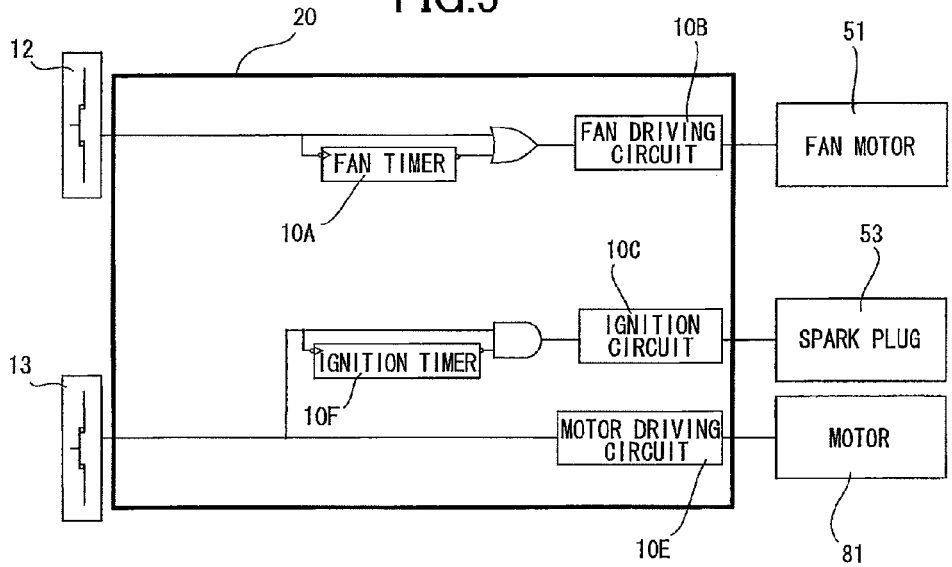
FIG. 5 is a block diagram showing an electric configuration of a screw driving machine according to a first modification of the first embodiment of the invention.
Figure 6:
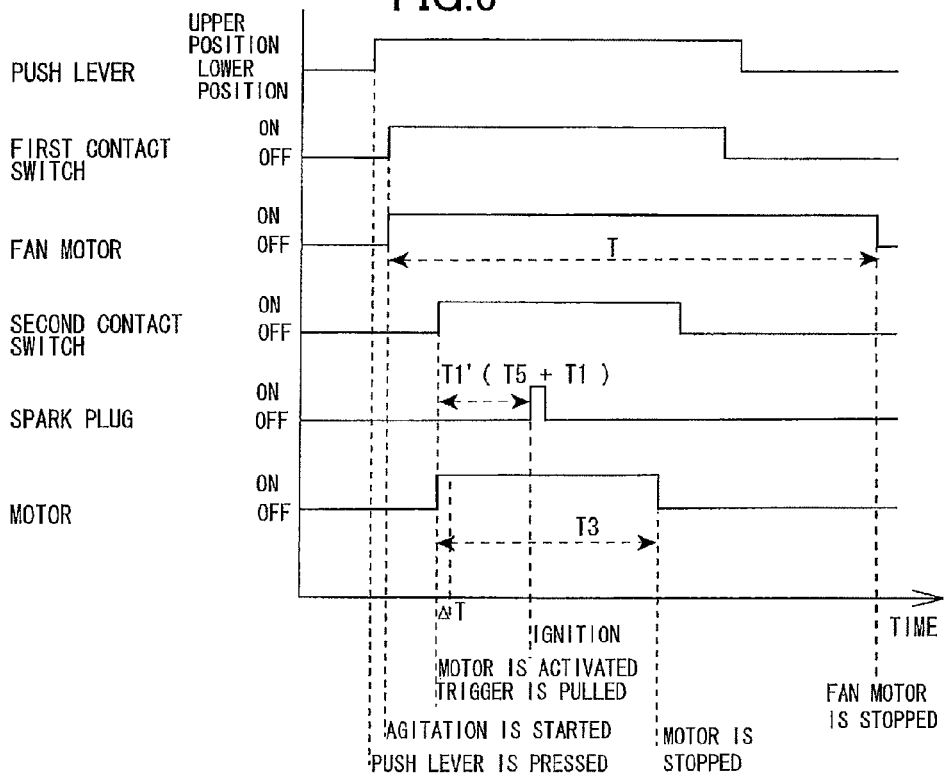
FIG. 6 is a time chart of operations of the screw driving machine according to the first modification of the first embodiment.

More specifically, as shown in FIGS. 5 and 6, in a control device 20 of this modification, the motor driving circuit 10E energizes the motor 81 when the second contact switch 13 outputs the ON signal. An ignition timer 10F is configured to output an ON signal when a time duration T5 has elapsed after the second contact switch 13 outputs the ON signal. The ignition circuit 10C supplies the electric power to the spark plug 53 for an extreme short time when both the second contact switch 13 and the ignition timer 10F output the ON signals.

Next, operations according to this modification will be described with reference to the time chart shown in FIG. 6. Because the operations regarding the push lever 9 and the first contact switch 12 are identical to those of the first embodiment shown in FIG. 4, explanation thereof will be omitted.

As shown in FIG. 6, when the second contact switch 13 outputs the ON signal as a result of an operator pulling the trigger 61, the ignition timer 10F measures the time duration T5, and outputs the ON signal after having measured the time duration T5. As a result, the ignition circuit 10C energizes (supplies the electric power to) the spark plug 53. Because the spark plug 53 is only ignited when the time duration T1 has elapsed after the energization as described above, the spark plug 53 is ignited when a time duration T1' has elapsed after the second contact switch 13 outputs the ON signal.

On the other hand, the motor driving circuit 10E supplies the electric power to the motor 81 when the second contact switch 13 outputs the ON signal, and the motor 81 starts the rotation. Because the time duration T1' is longer than the time duration ΔT, the motor 81 enters the steady rotation state before the piston 31 and the bit 32 reach the predetermined position at the lower dead point side after the ignition of the spark plug 53. Thus, it is possible to strike the screw 1A with the bit 32 and to rotate the screw 1A to the workpiece in a preferable manner.

Figure 7:
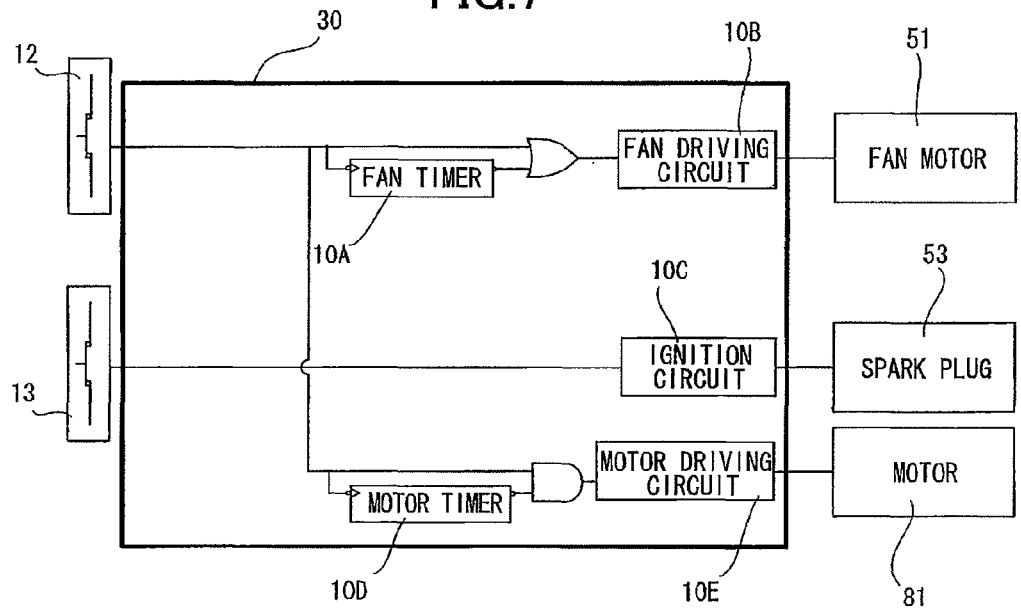
FIG. 7 is a block diagram showing an electric configuration of a screw driving machine according to a second modification of the first embodiment of the invention.
Figure 8:
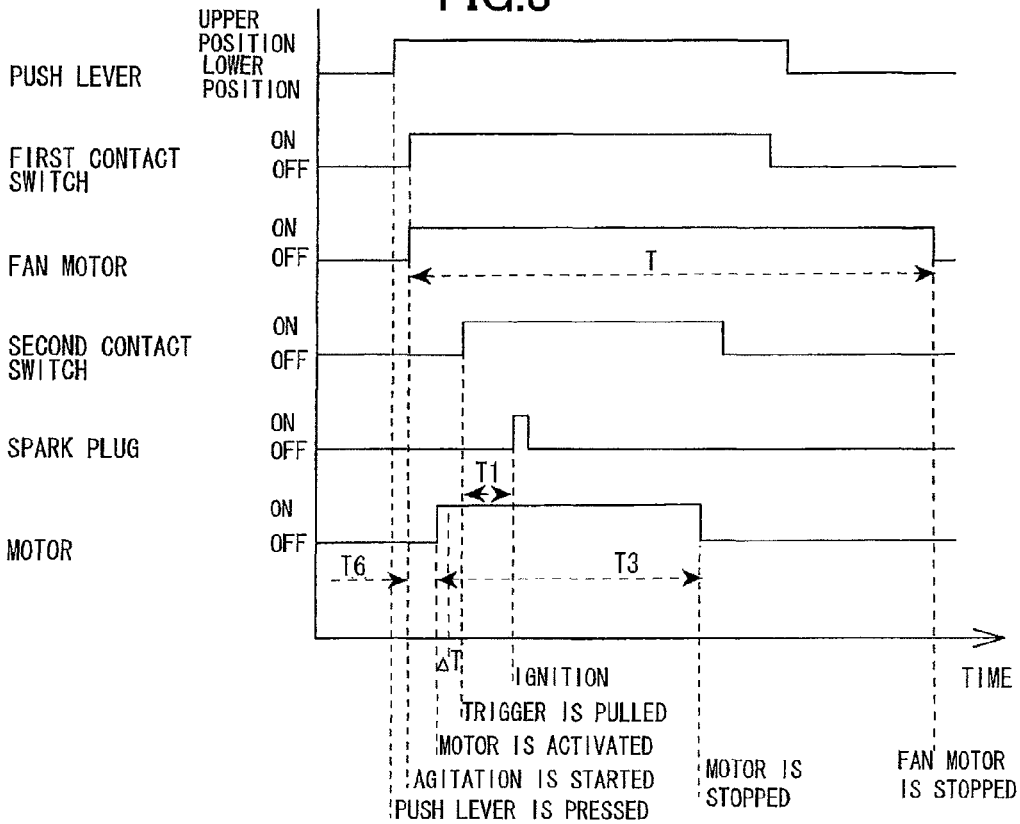
FIG. 8 is a time chart of operations of the screw driving machine according to the second modification of the first embodiment.

Next, a second modification of the first embodiment will be decried with reference to FIGS. 7 and 8.

In a control device 30 of this modification, the motor timer 10D is configured to output the ON signal when a time duration T6 has elapsed after detecting the ON signal from the first contact switch 12. The motor driving circuit 10E supplies the electric power to the motor 81 when the motor driving circuit 10E detects the ON signals from both the first contact switch 12 and the motor timer 10D. Also, the ignition circuit 10C is configured to energize the spark plug 53 when the ON signal from the second contact switch 13 is detected.

Note that the time duration T6 may be set to an arbitrary time duration, but preferably a time duration that enables the motor 81 to start rotating before the ignition of the spark plug 53. That is, if the time duration T6 is excessively long, then the motor 81 only starts rotating after the ignition.

Next, operations according to this modification will be described with reference to the time chart shown in FIG. 8. Because the operations regarding the push lever 9, the first contact switch 12, and the fan motor 51 are identical to those of the first embodiment shown in FIG. 4, explanation thereof will be omitted.

As shown in FIG. 8, when the first contact switch 12 outputs the ON signal, the fan driving circuit 10B starts supplying the electric power to the fan motor 51. Also, the motor timer 10D outputs the ON signal after the time duration T6 has elapsed after detecting the ON signal from the first contact switch 12, casing the motor 81 to rotate.

When the operator pulls the trigger 61 while pressing the push lever 9 against the workpiece (i.e., after the push lever 9 reaches the upper position), the second contact switch 13 outputs the ON signal, causing the ignition circuit 10C to energize the spark plug 53. The spark plug 53 is ignited when the time duration T1 has elapsed, lowering the piston 31 and the bit 32 to strike the screw 1A against the workpiece.

In this second modification also, the motor 81 enters the steady rotation state before the piston 31 and the bit 32 move toward the lower dead point, as in the first modification. Thus, it is possible to strike the screw 1A with the bit 32 and to rotate the screw 1A to the workpiece in a preferable manner.

Figure 9:
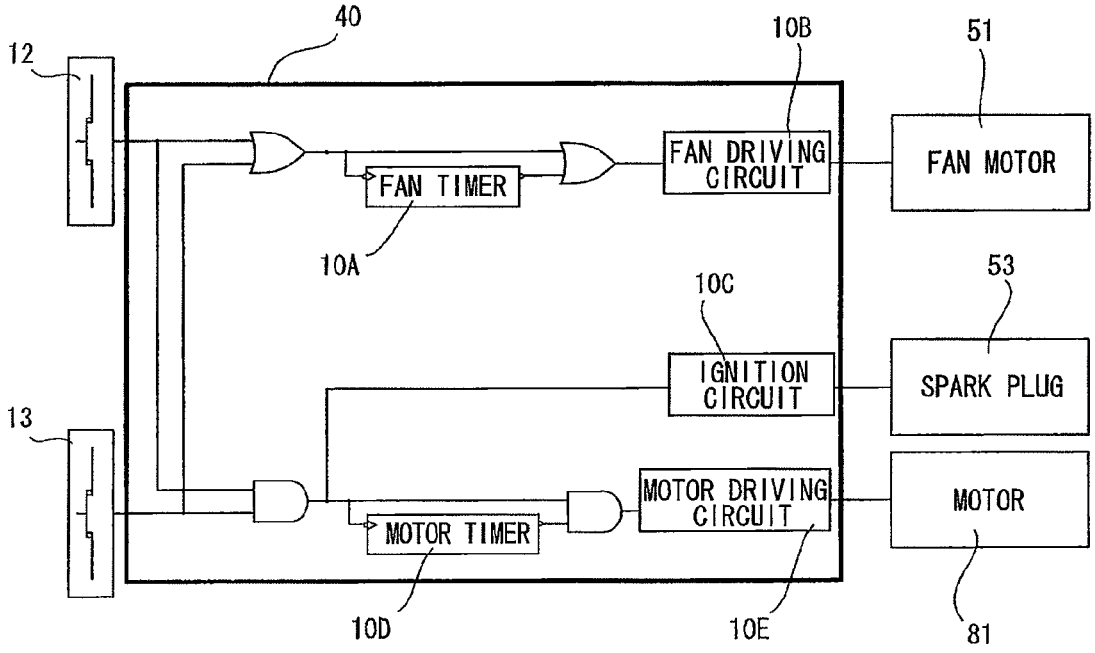
FIG. 9 is a block diagram showing an electric configuration of a screw driving machine according to a third modification of the first embodiment of the invention.

Next, a screw driving machine according to a third modification of the first embodiment of the invention will be described. The screw driving machine of this modification includes a control device 40 shown in FIG. 9. In the control device 40, the fan timer 10A starts counting when at least one of the first contact switch 12 and the second contact switch 13 outputs the ON signal, and the fan driving circuit 10B supplies the electric power to the fan motor 51 when at least one of the first contact switch 12, the second contact switch 13, and the fan timer 10A outputs the ON signal. Also, the ignition circuit 10C energizes the spark plug 53 when both the first contact switch 12 and the second contact switch 13 output the ON signals. The motor timer 10D starts counting when both the first contact switch 12 and the second contact switch 13 output the ON signals, and the motor driving circuit 10E supplies the electric power to the motor 81 when all of the first contact switch 12, the second contact switch 13, and the motor timer 10D output the ON signals.

With this configuration, it is possible to strike and rotate the screw 1A regardless of whether an operator presses the push lever 9 on the workpiece first or pulls the trigger 61 first.

Next, a screw driving machine 101 according to a second embodiment of the invention will be described with reference to FIGS. 10 to 13. The screw driving machine 101 differs from the screw driving machine 1 in having an electrical power mechanism 108 and a control device 110 instead of the electrical power mechanism 8 and the control device 10.

Figure 10:
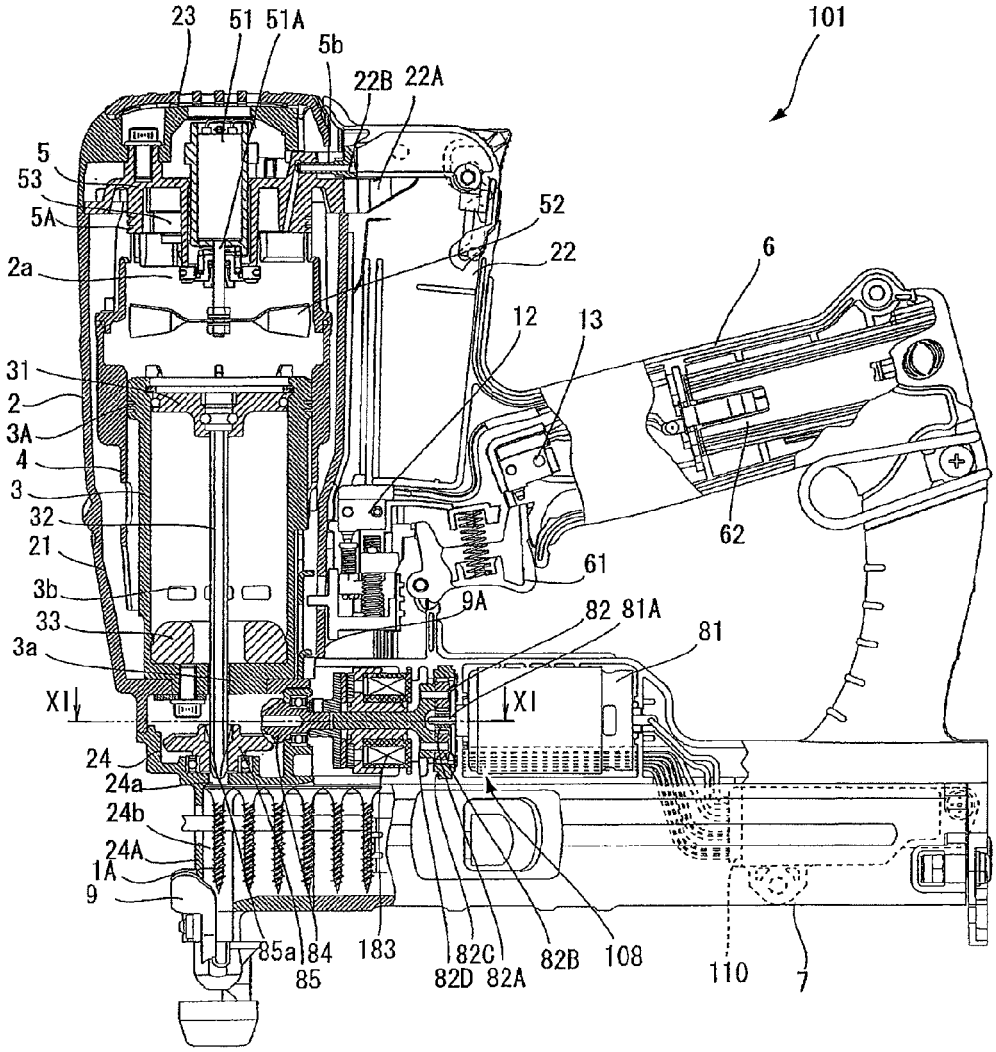
FIG. 10 is a cross-sectional view of a screw driving machine according to a second embodiment of the invention.
Figure 11:
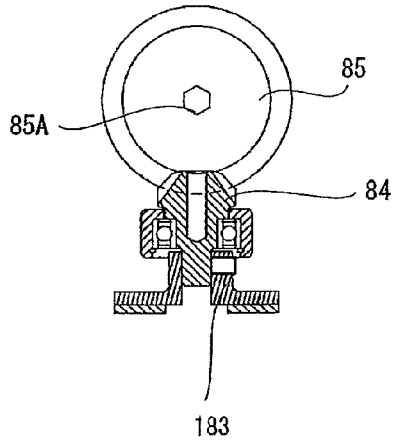
FIG. 11 is a cross-sectional view taken along a line XI-XI of FIG. 1.

As shown in FIG. 10, the electrical power mechanism 108 is the same as the electrical power mechanism 8 shown in FIG. 1, but differs in further including an electromagnetic clutch 183. As shown in FIG. 11, the electromagnetic clutch 183 is provided to the bevel gear 84 that is in meshing engagement with the final gear 85. The remaining configuration of the electrical power mechanism 108 is the same as that of the electrical power mechanism 8, so the detailed description thereof will be omitted.

As shown in FIG. 10, the electromagnetic clutch 183 is interposed between the planetary gear mechanism 82 and the bevel gear 84, and is switched between a connected state and a disconnected state based on ON/OFF of power supply from a clutch driving circuit 110H (FIG. 12) to be described later. When the electromagnetic clutch 183 is in the connected state, the electromagnetic clutch 183 transmits the electric power from the planetary gear mechanism 82 to the bevel gear 84. When the electromagnetic clutch 183 is in the disconnected state, on the other hand, the electromagnetic clutch 183 does not transmit the electric power to the bevel gear 84.

Figure 12:
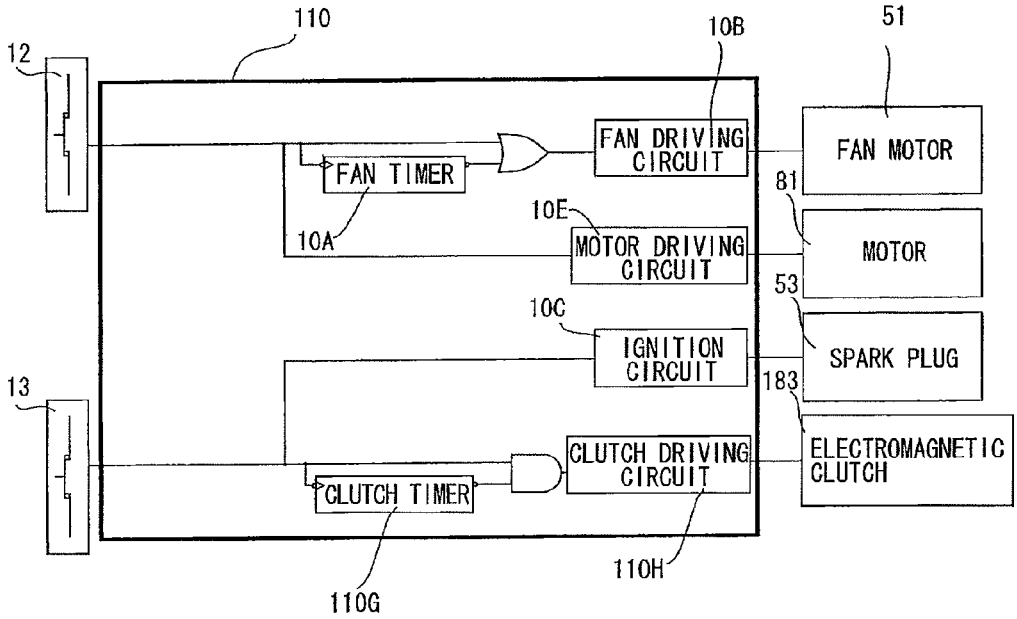
FIG. 12 is a block diagram showing an electric configuration of the screw driving machine of FIG. 10.

As shown in FIG. 12, the control device 110 includes the fan timer 10A, the fan driving circuit 10B, the ignition circuit 10C, the motor driving circuit 10E, a clutch timer 110G, and the clutch driving circuit 110H. The fan timer 10A, the fan driving circuit 10B, and the ignition circuit 10C are the same as those shown in FIG. 3 of the first embodiment.

The motor driving circuit 10E is configured to supply the electric power to the motor 81 when the first contact switch 12 outputs the ON signal and to halt supplying the electric power when the first contact switch 12 outputs the OFF signal.

Figure 13:
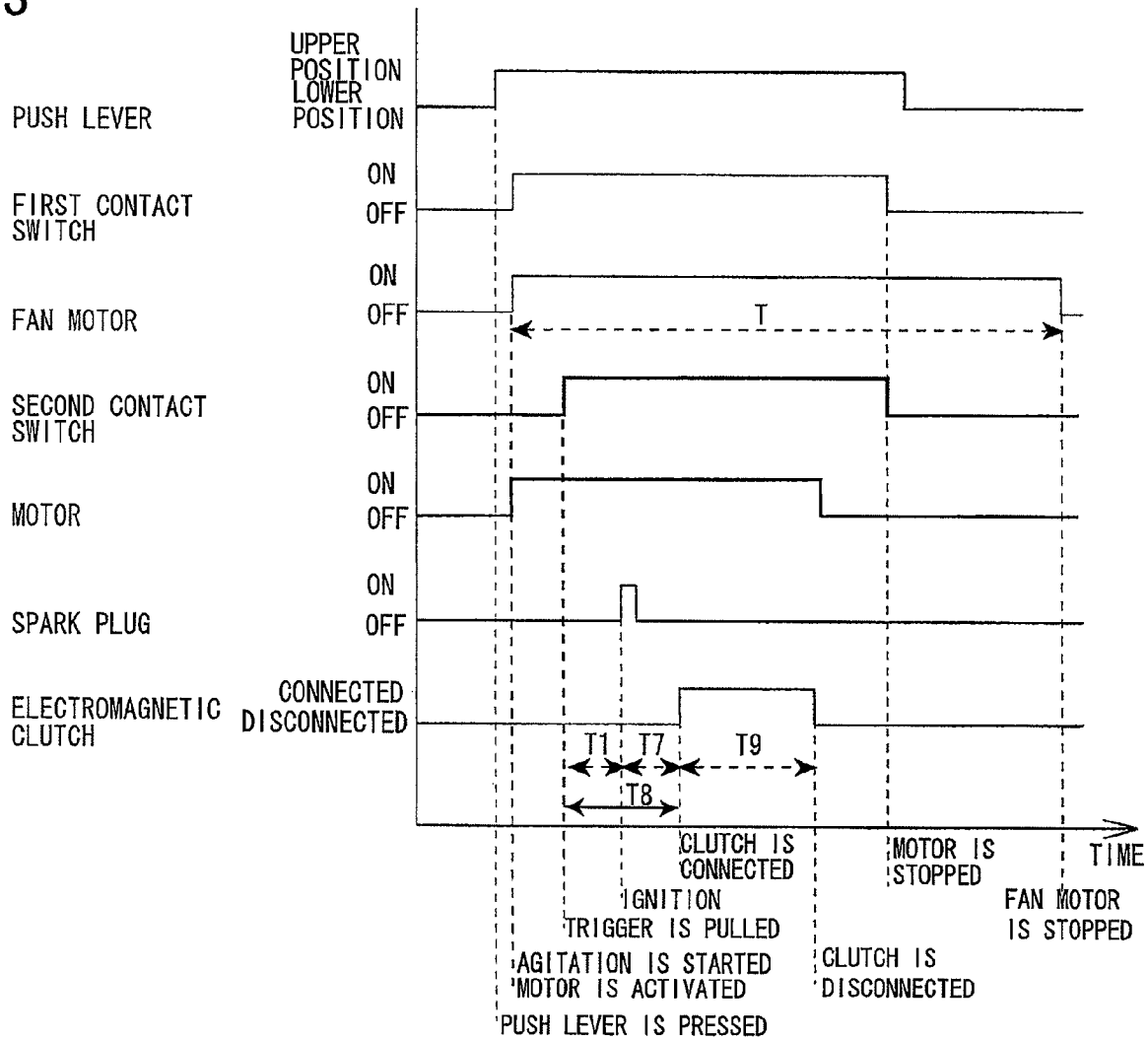
FIG. 13 is a time chart of operations of the screw driving machine of FIG. 10.

Referring to FIGS. 12 and 13, the clutch timer 110G outputs an ON signal when a time duration T8 has elapsed after the second contact switch 13 outputs the ON signal such that the clutch driving circuit 110H only supplies the electric power to the electromagnetic clutch 183 when a time duration T7 has elapsed after the spark plug 53 is ignited, which is when the time duration T1 has elapsed after the second contact switch 13 outputs the ON signal. That is, the time duration T8=the time duration T1+the time duration T7. Also, the clutch timer 110G is configured to output an OFF signal after outputting the ON signal for a time duration T9.

The clutch driving circuit 110H is connected to the electromagnetic clutch 183, and supplies the electric power to the electromagnetic clutch 183 when both the second contact switch 13 and the clutch timer 110G output the ON signals. Because of the above-described configuration, the clutch driving circuit 110H puts the electromagnetic clutch 183 into the connected state when the time duration T7 has elapsed after the ignition of the spark plug 53.

Next, operations of the screw driving machine 101 will be described with reference to the time chart of FIG. 13.

Because the operations regarding the push lever 9, the first contact switch 12, and the motor 81 are the same as those of the first embodiment shown in FIG. 4, description thereof will be omitted.

When the first contact switch 12 outputs the ON signal, the motor driving circuit 10E supplies the electric power to the motor 81, and the motor 81 rotates to generate driving force.

At this moment, the electromagnetic clutch 183 is in the disconnected state. Thus, the driving power generated by the motor 81 is not transmitted to the final gear 85 or the bit 32.

When the operator pulls the trigger 61 thereafter, the second contact switch 13 outputs the ON signal. As a result, the ignition circuit 10C energizes the spark plug 53, and the spark plug 53 is ignited after the time duration T1. This ignition ignites the gas mixture in the combustion chamber 2*a*, and lowers the piston 31 and the bit 32 to strike the screw 1A against the workpiece.

Also, the clutch timer 110G outputs the ON signal when the time duration T8 has elapsed after the second contact switch 13 outputs the ON signal. As a result, the clutch driving circuit 110H supplies the electric power to the electromagnetic clutch 183 to put the electromagnetic clutch 183 in the connected state. That is, the electromagnetic clutch 183 enters the connected state when the time duration T8 has elapsed after the second contact switch 13 outputted the ON signal.

When the electromagnetic clutch 183 is in the connected state, the driving power generated at the motor 81 is transmitted to the final gear 85 through the planetary gear mechanism 82 in a reduced speed. Thus transmitted driving power rotates the bit 32 to rotate the screw 1A to the workpiece. Because the motor 81 enters the steady rotation state by the time the electromagnetic clutch 183 enters the connected state, the driving power generated at the motor 81 in the steady rotation state is transmitted to the final gear 85.

Because the clutch timer 110G outputs the OFF signal after outputting the ON signal for the time duration T9, the electromagnetic clutch 183 enters the disconnected state when the time duration T9 has elapsed after entering the connected state, even if the second contact switch 13 still outputs the ON signal. Setting the time duration T9 to an appropriate duration prevents the screw 1A from being rotated excessively.

As described above, because the screw driving machine 101 of this embodiment includes the electromagnetic clutch 183, the screw 1A is rotated only after the motor 81 has entered the steady rotation state. That is, it is possible to rotate the screw 1A in a condition where the motor 81 generates the driving force at the maximum level. This reliably rotates the screw 1A in a suitable manner and avoids poor rotating (screwing).

Also, because the motor 81 can start rotating before the ignition of the spark plug 53, the timing to start the rotation of the motor 81 needs not to be precise depending on the ignition timing of the spark plug 53. This makes easier to set the rotation start timing of the motor 81. Also, the timing to start rotation (timing to start rotating the bit 32) can be set to an arbitrary timing after the ignition, in accordance with the material of the workpiece, for example. Because the driving force of the maximum level generated at the motor 81 is used, it unnecessary for the motor 81 to be an excessively-large-sized motor of excessively high output, but can be a small-sized motor capable of outputting sufficient driving force to rotate the screw 1A at its maximum level.

The planetary gear mechanism 82 as the deceleration mechanism is interposed between the electromagnetic clutch 183 and the output shaft 81A as described above. This means that the electromagnetic clutch 183 is located between the output shaft 81A and the final gear 85 at a position where the rotation speed is lower and the axial force is larger. This configuration reduces loss of rotation speed when the electromagnetic clutch 183 is switched from the disconnected state to the connection state, and supplies the rotative force to the bit 32 in a preferable manner. Also, because the planetary gear mechanism 82 is used, a large torque can be obtained at the final gear 85 even if the motor 81 is small and low output, the screw driving machine 101 can be made further smaller in size.

Figure 14:
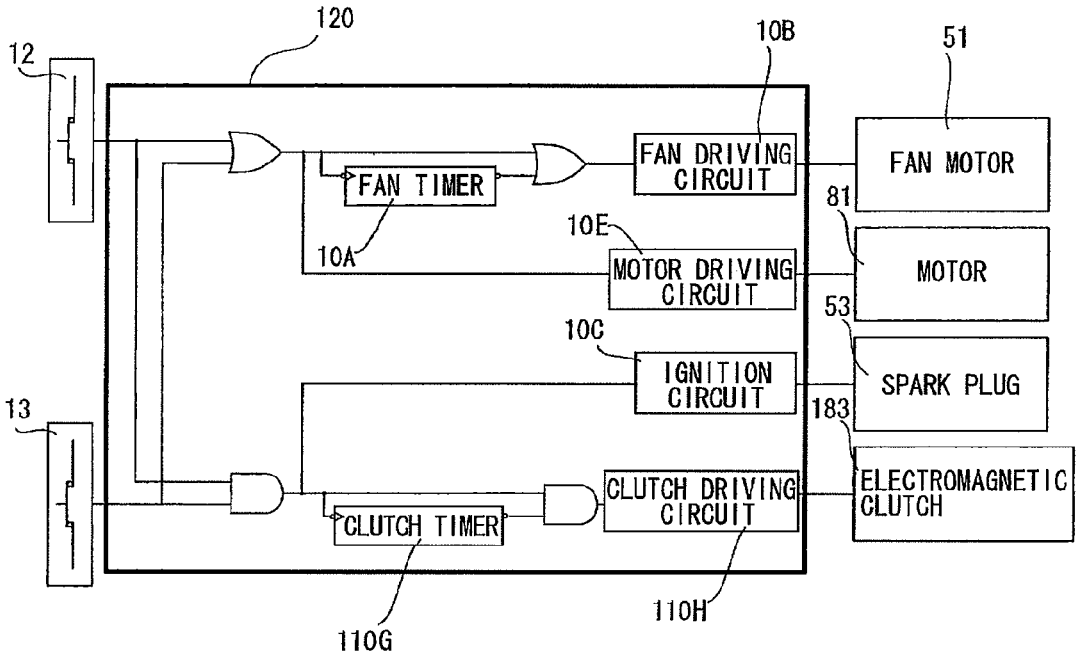
FIG. 14 is a block diagram showing an electric configuration of a screw driving machine according to a modification of the second embodiment of the invention.

Next, a screw driving machine according to a modification of the above-described second embodiment will be described with reference to FIG. 14. The screw driving machine of this modification is the same as the screw driving machine 101 of the second embodiment, but differs in having a control device 120 shown in FIG. 14. In the control device 120, the fan timer 10A and the motor driving circuit 10E operate when at least one of the first contact switch 12 and the second contact switch 13 outputs the ON signal, and the fan driving circuit 10B supplies the electric power to the fan motor 51 when at least one of the fan timer 10A, the first contact switch 12, and the second contact switch 13 outputs the ON signal. Also, the clutch timer 110G and the ignition circuit 10C operate when both the first contact switch 12 and the second contact switch 13 output the ON signals, and the clutch driving circuit 110H supplies the electric power to the electromagnetic clutch 183 when all of the clutch timer 110G, the first contact switch 12, and the second contact switch 13 output the ON signals.

With this configuration, it is possible to strike and fasten (rotate) the screw 1A regardless of whether an operator presses the push lever 9 on the workpiece first or pulls the trigger 61 first.

While the invention has been described in detail with reference to the embodiments thereof, it would be apparent to those skilled in the art that various changes and modifications may be made therein without departing from the spirit of the invention.

For example, the screw driving machines may include an actuator including an output shaft that reciprocates when supplied with electric power instead of the motor 81. In this case, the output shaft is used as a rack, and the final gear 85 is a pinion engaged with the bit 32. With this configuration, rotative force can be applied to the bit 32.

Also, an electromechanical clutch may be used as the electrical clutch mechanism, instead of the electromagnetic clutch 183.

In the above-described embodiments, the intermediate gear section and the deceleration mechanism include the planetary gears and the bevel gears. However, the motor 81 may be disposed such that the output shaft 81A extends in the axis direction of the bit 32, and a plurality of spur gears may be disposed between the motor 81 and the bit 32. Also, a rack and a pinion may be used.

What is claimed is:

1. A screw driving machine comprising:

a housing;

a bit that is movable from a first position to a second position relative to the housing to strike a screw against a workpiece and that is rotatable about an axis thereof to rotate the screw to the workpiece;

a push lever that is movable between a third position and a fourth position relative to the housing, the push lever moving from the third position to the fourth position when pressed against the workpiece;

a combustion-type power mechanism that defines a combustion chamber when the push lever is located at the fourth position, the combustion-type power mechanism including a spark plug that ignites combustible gas filled in the combustion chamber to apply striking force to the bit toward the second position, causing the bit to strike the screw, the spark plug igniting the combustible gas when supplied with electric power;

a motor that generates a rotative force when supplied with electric power;

a power transmission mechanism that transmits the rotative force generated at the motor to the bit, causing the bit to rotate;

a trigger to be operated by an operator;

a power source that supplies the electric power to both the spark plug and the motor;

a first contact switch that outputs a first signal when the first contact switch detects the movement of the push lever;

a second contact switch that outputs a second signal when the second contact switch detects the operator's operation on the trigger; and a control unit that supplies the electric power from the power source to the spark plug at a first timing based on outputting one or both of the first signal and the second signal, and that supplies the electric power to the motor at a second timing based on outputting one or both of the first signal and the second signal.

2. The screw driving machine according to claim 1, wherein the second timing is such that the motor enters a steady rotation state when a predetermined time duration has elapsed after the ignition of the spark plug.

3. The screw driving machine according to claim 2, wherein the predetermined time duration is equivalent to a time duration required by the bit to move from the first position to the second position.

4. The screw driving machine according to claim 1, wherein the second timing is such that the motor starts rotating before the bit starts moving toward the second position.

5. The screw driving machine according to claim 1, wherein:

the power transmission mechanism includes an electrical clutch that selectively connects and disconnects between the motor and the bit; and the control unit controls the electrical clutch to connect between the motor and the bit after the bit starts moving toward the second position.

6. A screw driving machine comprising:

a housing;

a bit that is movable from a first position to a second position relative to the housing to strike a screw against a workpiece and that is rotatable about an axis thereof to rotate the screw to the workpiece;

a push lever that is movable between a third position and a fourth position relative to the housing, the push lever moving from the third position to the fourth position when pressed against the workpiece;

a combustion-type power mechanism that defines a combustion chamber when the push lever is located at the fourth position, the combustion-type power mechanism including a spark plug that ignites combustible gas filled in the combustion chamber to apply striking force to the bit toward the second position, causing the bit to strike the screw, the spark plug igniting the combustible gas when supplied with electric power;

a motor that generates a rotative force when supplied with electric power;

a power transmission mechanism that transmits the rotative force generated at the motor to the bit, causing the bit to rotate, the power transmission mechanism including an electrical clutch that selectively connects and disconnects between the motor and the bit;

a trigger to be operated by an operator;

a power source that supplies the electric power to both the spark plug and the motor;

a control unit that supplies the electric power from the power source to the spark plug at a first timing based on one or both of an operator's operation on the trigger and the movement of the push lever to the fourth position and that supplies the electric power to the motor at a second timing;

a first contact switch that outputs a first signal when the first contact switch detects the movement of the push lever; and a second contact switch that outputs a second signal when the second contact switch detects the operator's operation on the trigger, wherein:

the control unit supplies the electric power from the power source to the spark plug at the first timing based on outputting one or both of the first signal and second signal, and that supplies the electric power to the motor at the second timing based on outputting one or both of the first signal and the second signal; and the control unit controls the electrical clutch to maintain to disconnect between the motor and the bit when none of the first signal and the second signal is output, and controls the electrical clutch to connect between the motor and the bit after the bit starts moving toward the second position.

* * * * *